US007121861B2

(12) United States Patent
Tseng et al.

(10) Patent No.: US 7,121,861 B2
(45) Date of Patent: Oct. 17, 2006

(54) ELECTRICAL CARD CONNECTOR

(75) Inventors: Gwou-Jong Tseng, Tu-Chen (TW); Xin Yao Tang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/319,340

(22) Filed: Dec. 27, 2005

(65) Prior Publication Data

US 2006/0141839 A1 Jun. 29, 2006

(30) Foreign Application Priority Data

Dec. 25, 2004 (CN) ..... 2004 2 0054715

(51) Int. Cl.
*H01R 13/62* (2006.01)

(52) U.S. Cl. ..... 439/326; 439/66

(58) Field of Classification Search ..... 439/325, 439/326, 327, 328, 66, 108
See application file for complete search history.

(56) References Cited

U.S. PATENT DOCUMENTS 5,088,929 A * 2/1992 Enomoto ..... 439/66
5,690,502 A * 11/1997 Mochizuki ..... 439/320
6,540,539 B1 * 4/2003 Yahiro et al. ..... 439/326
6,890,202 B1 * 5/2005 Yasufuku et al. ..... 439/331
6,971,899 B1 * 12/2005 Liu ..... 439/326

* cited by examiner

*Primary Examiner*—Hien Vu
(74) *Attorney, Agent, or Firm*—Wei Te Chung

(57) ABSTRACT

An electrical card connector (1) for receiving an electrical card (100) includes a longitudinal insulative housing (10) and a plurality of conductive contacts (20) received in the insulative housing. Each contact includes a contact portion (204) projecting beyond the insulative housing. The electrical card is pressed to contact with the conductive contacts. A holding piece (30) is received in a rear portion of the insulative housing and provided for holding the electrical card.

6 Claims, 7 Drawing Sheets

ELECTRICAL CARD CONNECTOR

BACKGROUND OF THE INVENTION

1. Field of the Invention

This invention generally relates to an electrical card connector, and more particularly to one provided with simplified structure.

2. Description of the Prior Art

Conventional electrical card connector used in portable electronic devices for connecting an electrical card to a printed circuit board includes an insulative housing, a plurality of electrodes or contacts exposed in the housing for electrically connecting with circuit traces of the card and a holding device permitting the card to insert and remove therefrom.

U.S. Patent application publication No. 2005/0106921 A1 discloses such an electrical card connector for receiving mini SD card. The conventional electrical card connector includes an insulative housing and a plurality of conductive contacts. The insulative housing includes a pair of clamping arms which define a pair of retaining ribs for fastening the mini SD card. Since the conventional electrical card connector provides the retaining rib additionally to retain the mini SD card, thereby exceed the longitudinal length of the electrical card connector. In addition, it is not conventional to push the electrical card out of the electrical card connector.

Hence, an improved electrical card connector having a simplified structure is needed to solve the above problems.

BRIEF SUMMARY OF THE INVENTION

It is an object of the present invention to provide a miniature electrical card connector.

In order to attain the objective above, an electrical card connector for receiving an electrical card includes an insulative housing defining a plurality of channels and a plurality of conductive contacts received in the channels. Each conductive contact projects beyond the insulative housing. The electrical card connector further includes a holding piece disposed in a rear portion of the insulative housing. The holding piece has a pair of V-shaped cantilevered beams for fastening the electrical card.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
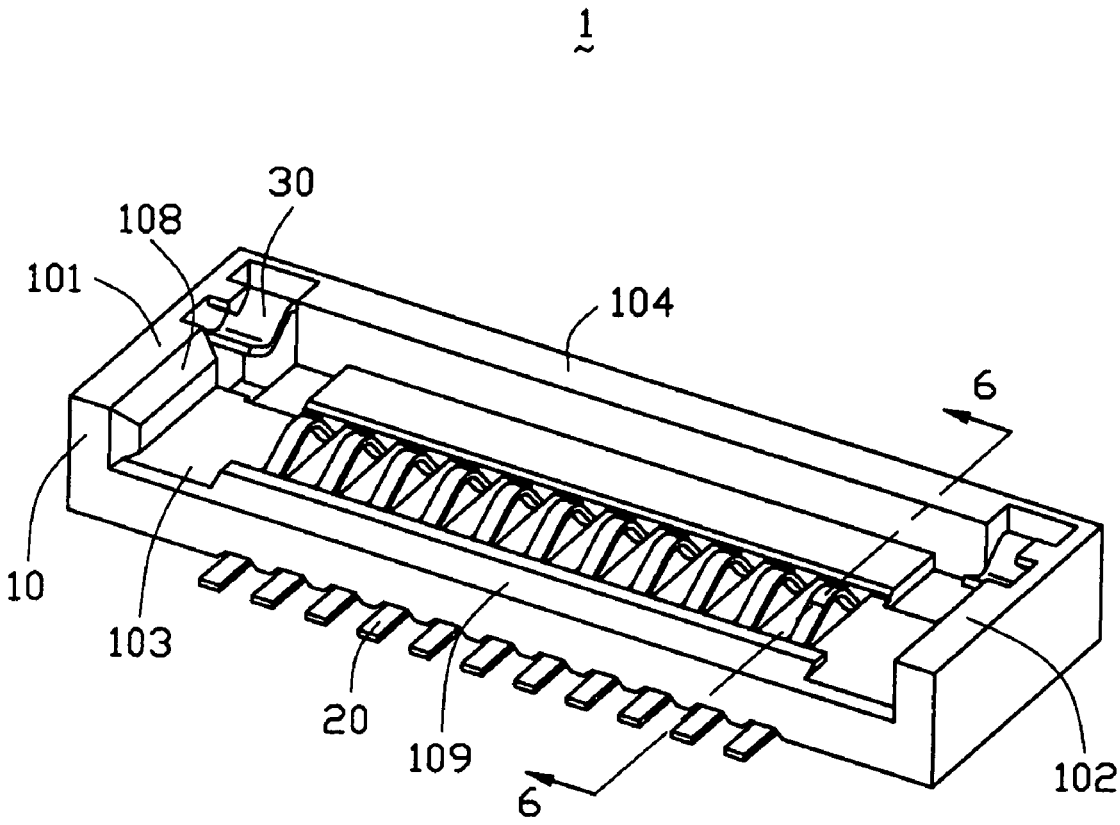
FIG. 1 is a perspective view of an electrical card connector according to the present invention.

Reference will now be made in detail to the preferred embodiment of the present invention.

Refer to FIGS. 1–4, an electrical card connector 1 according to the present invention includes a longitudinal insulative housing 10, a plurality of conductive contacts 20 received in the insulative housing 10, a pair of holding pieces 30 and a pair of soldering pieces 40.

Refer to FIGS. 3–6, the insulative housing 10 has an exposed open space facing downward to form an open recess (not labeled) for receiving the conductive contacts 20. The insulative housing includes a left side arm 101, a right side arm 102, a bottom wall 103 and a rear wall 104. The electrical card connector 1 provides a longitudinal through slot 105 forming between the bottom wall 103 and the rear wall 104. A rib 107 for connecting the bottom wall 103 and the rear wall 104 is formed in a middle portion of the through slot 105. A pair of protrusions 106 project into the recess from inner faces of the left side arm 101 and the right side arm 102, respectively. A pair of guiding faces 108 slant downwardly from the inner faces of the left side arm 101 and the right side arm 102. A leading face 109 is formed in a front portion of the bottom wall 103. A pair of through channels 110 for receiving the conductive contacts 20 is formed in the bottom wall 103. Each through channel 110 defines a stopper 111 at a front portion thereof. The bottom wall 103 further defines two rows of indentations 112 along the channel 110 and a pair of retaining grooves 113 adjacent to the left and right side arms 101, 102.

Figure 3:
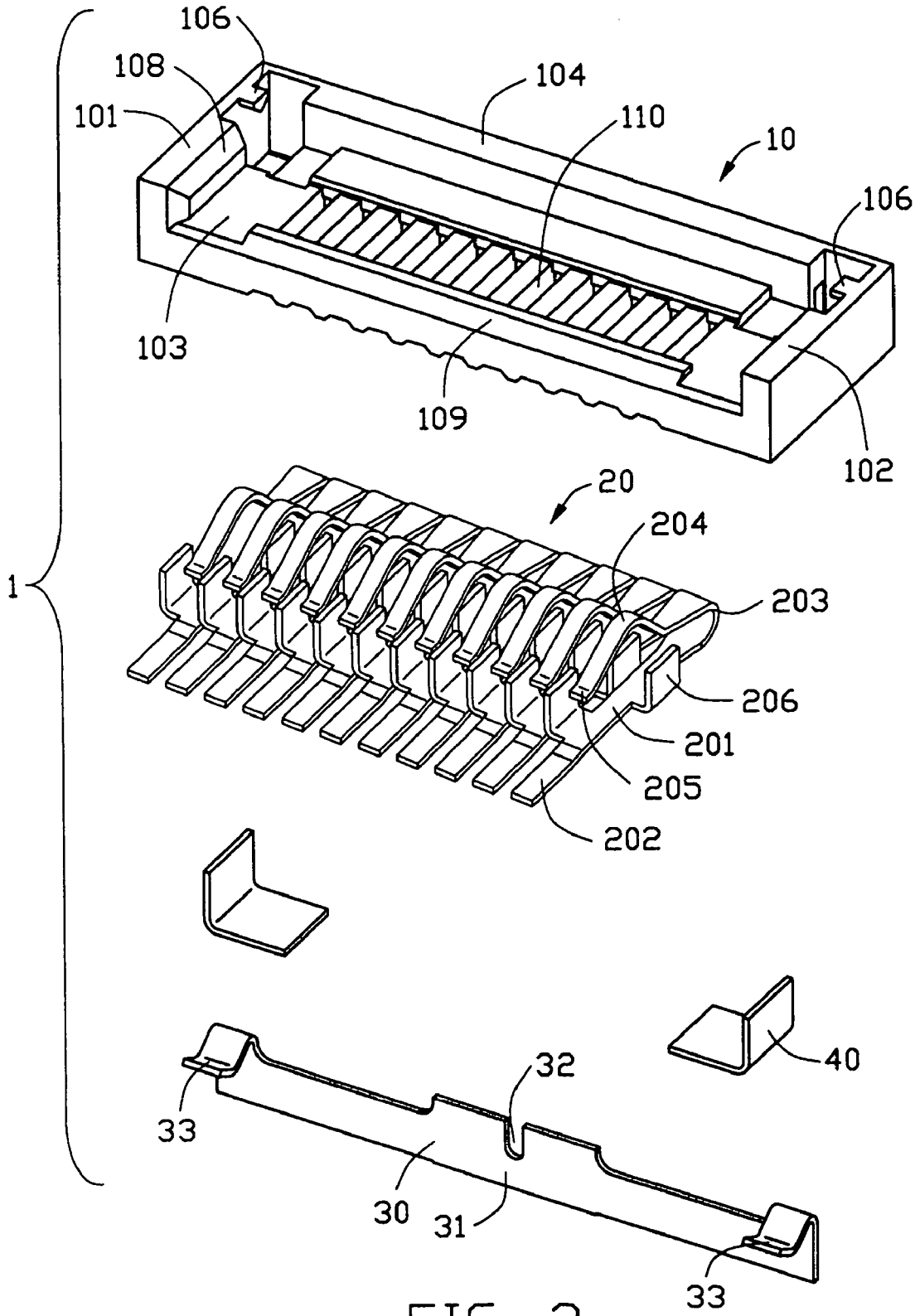
FIG. 3 is an exploded view of the electrical card connector of FIG. 1.
Figure 4:
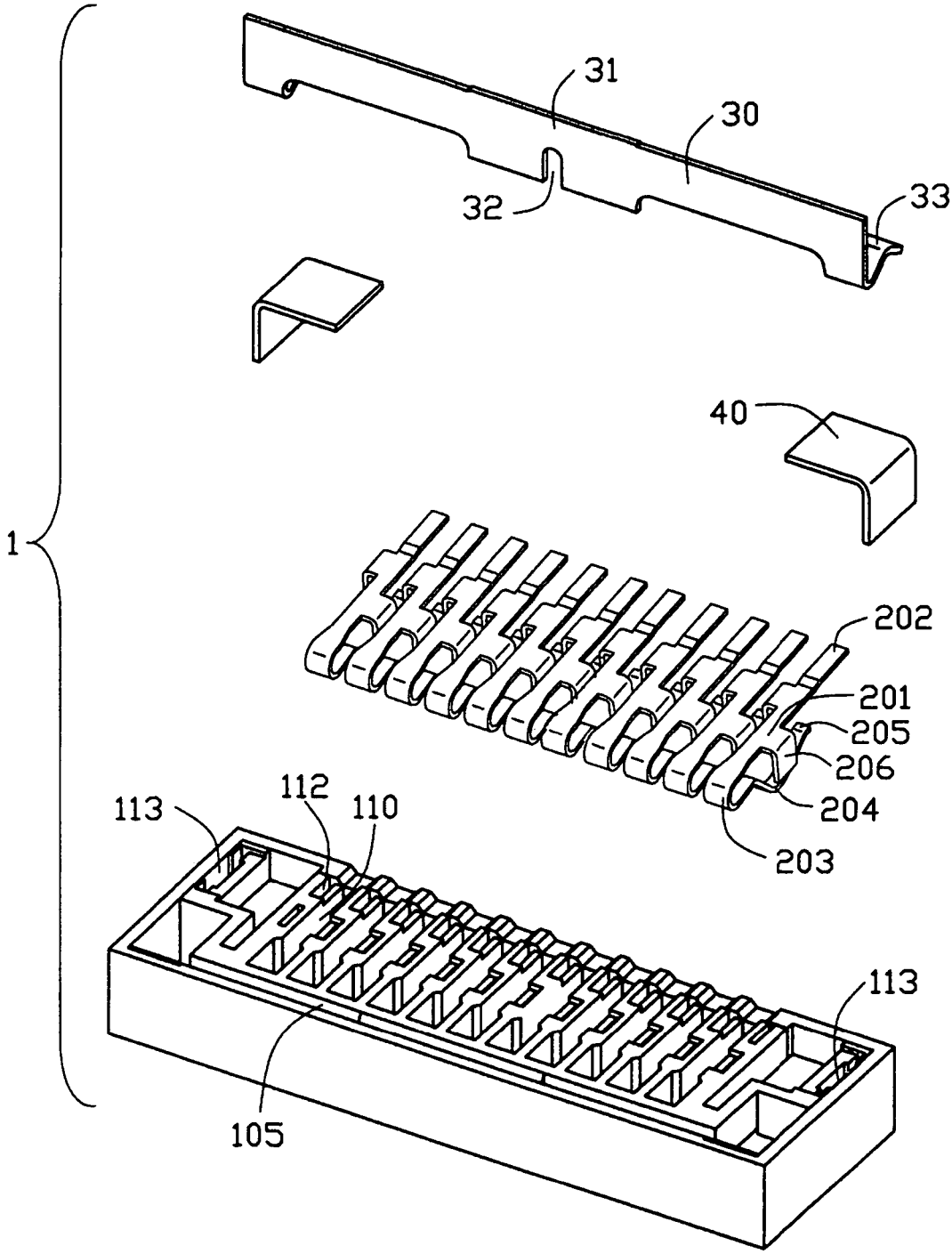
FIG. 4 is another exploded view of the electrical card connector of FIG. 2.
Figure 5:
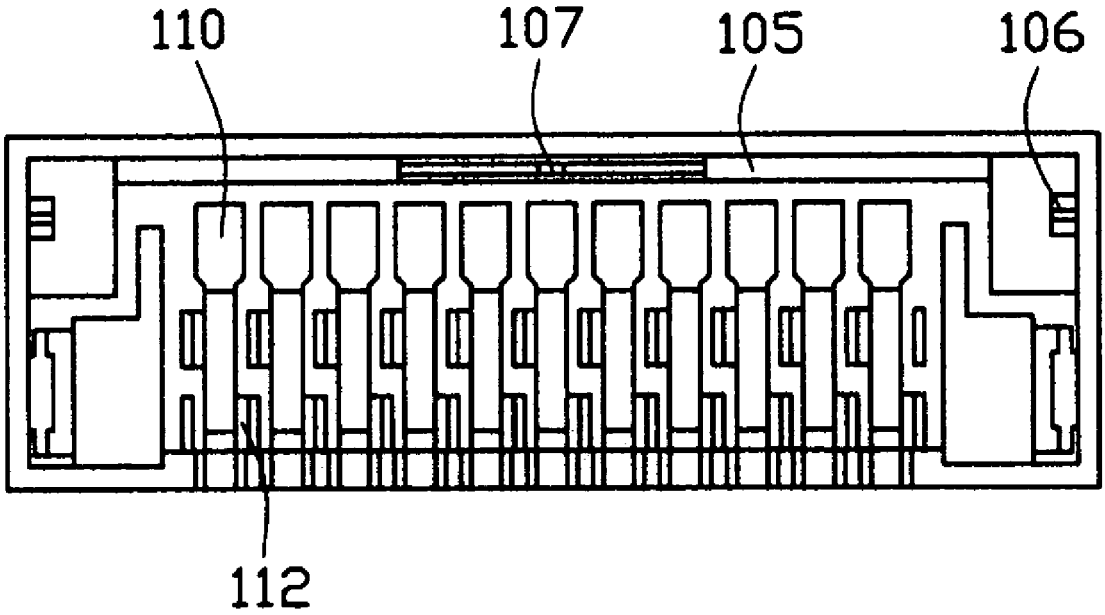
FIG. 5 is a bottom view of the electrical card connector.
Figure 6:
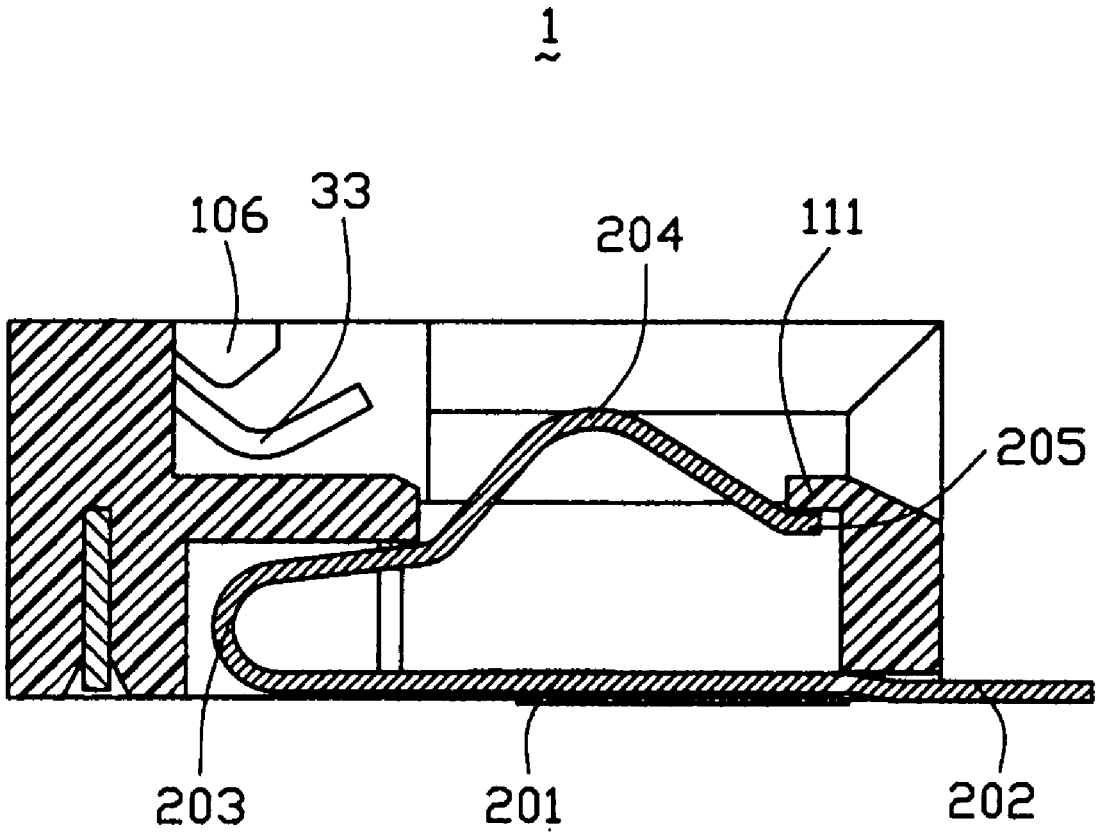
FIG. 6 is a cross section view of the electrical card connector taken from 6—6 line of FIG. 1.

Refer to FIGS. 3–4, each conductive contact 20 is stamped by a metal sheet and includes a body portion 201, a soldering portion 202 forwardly extending from the body portion 201, a U-shaped connecting portion 203 and a contact portion 204 bent and extending from the U-shaped connecting portion 203. A tab 205 is provided at a free portion of the contact portion 204. The body portion 201 forms a pair of fixing portion 206 upwardly extending from opposite sides thereof.

Each holding piece 30 includes a longitudinal base portion 31, a cutout 32 depressed from a middle portion of an upper edge of the base portion 31, a pair of V-shaped cantilevered beams 33 bent from opposite sides of the upper edge of the base portion 31.

The soldering portion 40 is substantially L-shaped metal sheet and provide barbs (not shown) at opposite edges of a vertical portion of the soldering portion 40.

Figure 2:
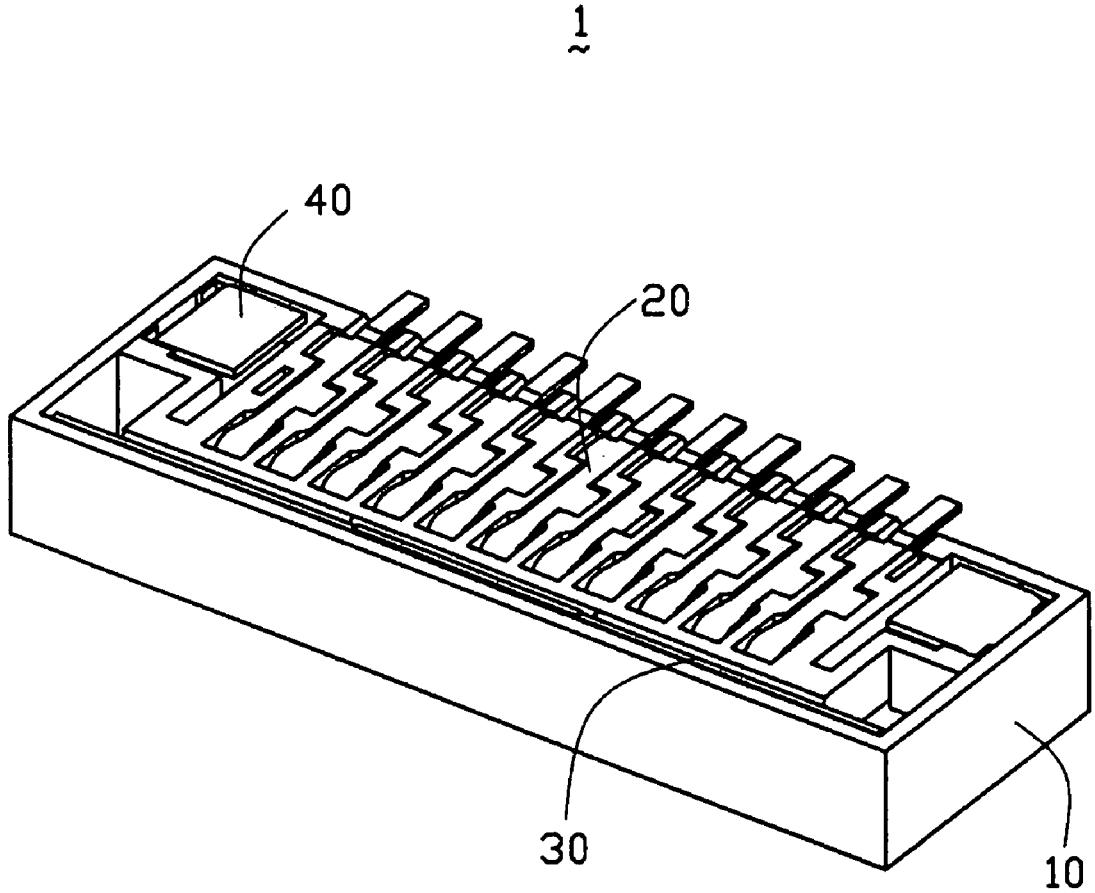
FIG. 2 is another perspective view of the electrical card connector from another view.

Refer to FIGS. 1–2, in assembly, the plurality of conductive contacts 20 is inserted into the channels 110 from up-to-bottom indirection. Each contact portion 204 projects into the open recess with the tab 205 abutting against the stopper 111 of the channel 110. The fixing portions 206 respectively are inserted into the indentations 112 of the bottom wall 103, thereby securing the conductive contacts 20 in the insulative housing 10.

The holding piece 30 is inserted into the through slot 105 from down-to-up direction with the U-shaped cutout 32 engaging with the rib 107 of the channel 105. The pair of V-shaped cantilevered beams 30 is positioned below the protrusions 106 of the left and right side arms 101, 102. The vertical portions of the soldering portions 40 are received in the retaining grooves 113 of the insulative housing 10.

Figure 7:
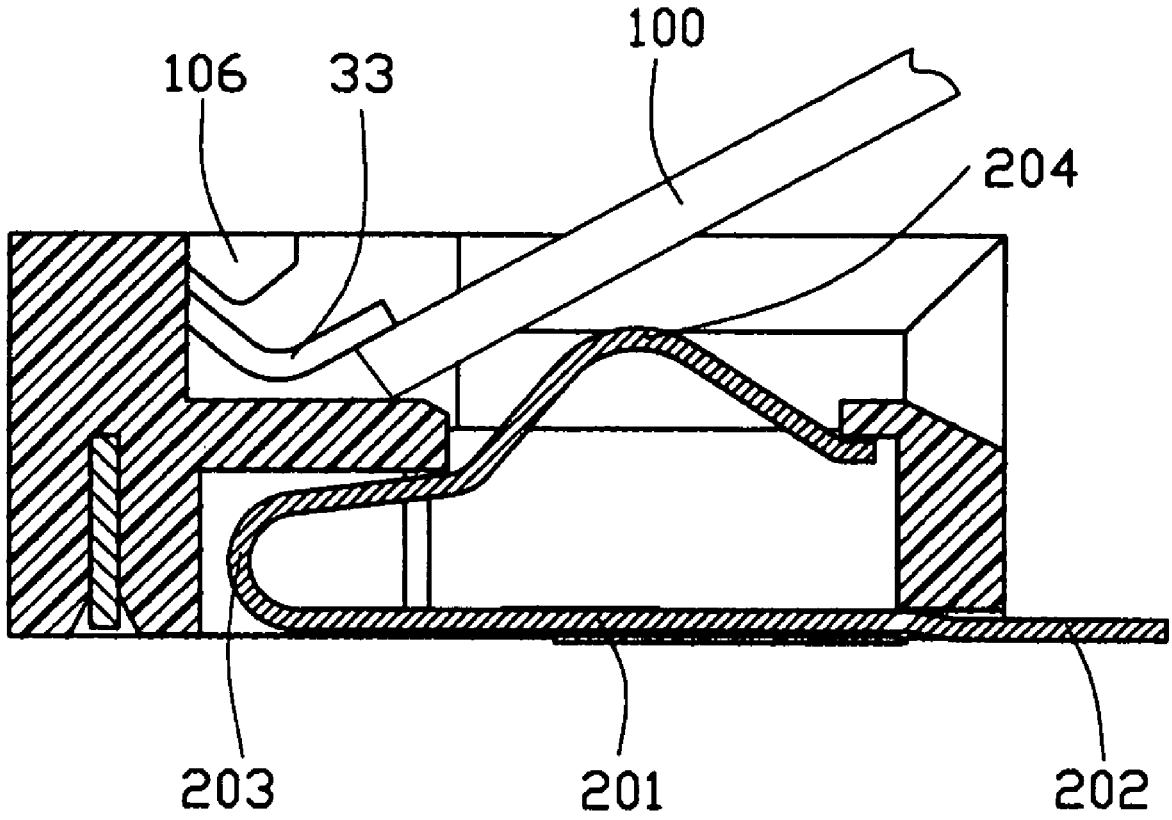
FIG. 7 is a diagram view of the electrical card connector with the electrical card being inserted thereinto.

In use, refer to FIG. 7, firstly the electrical card 100 is slant inserted between the V-shaped cantilevered beams 33 of the holding pieces 30 and the insulative housing 10, then downward press the electrical card 100 to contact with the conductive contacts 20.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical card connector for receiving an electrical card, comprising:

an insulative housing defining a plurality of channels;

a plurality of conductive contacts received in the channels; and a holding piece fixed in the insulative housing and fastening the electrical card in a direction oblique to the insertion direction of the electrical card, wherein the holding piece comprises a pair of cantilevered beams;

wherein the holding piece includes a base portion, the pair of cantilevered beams formed in opposite sides of the base portion;

wherein the insulative housing forms a pair of protrusions for preventing the cantilevered beams from rising;

wherein the insulative housing includes a pair of side arms, a bottom wall and a rear wall, thereby forming a receiving recess;

wherein the insulative housing defines a slot adjacent to the rear wall and extending through a bottom face of the bottom wall for receiving the holding piece; and wherein the conductive contact includes a body portion, a connecting portion, a contact portion bent and extending from the connecting portion and a pair of fixing portions at opposite sides of the body portion.

2. The electrical card connector according to claim 1, wherein each side arm defines a guiding face.

3. The electrical card connector according to claim 1, wherein the bottom wall forms a leading face in a front portion thereof.

4. An electrical connector assembly comprising:

an insulative housing adapted to be seated upon a printed circuit board and including a pair of side arms, a bottom wall and a rear wall, thereby defining card receiving cavity forwardly opening to an exterior;

a card seating surface provided on the housing below a top surface of said rear wall;

a plurality of terminals disposed at a lower level of the housing with contacting portions extending upwardly above the seating surface and soldering portions adapted to be mounted to the printed circuit board; and at least one up-and-down deflectable holding device performing no signal or power transmission and provided at an upper level of the housing; wherein said housing defines a downward slot extending through a bottom face of the housing to allow said holding device to be upwardly installed into the housing without risks of being upwardly withdrawn from the housing; wherein the holding device cooperates with the seating surface to sandwich therebetween a card which is located in the card receiving cavity;

wherein the holding piece comprises a pair of cantilevered beams;

wherein the holding piece includes a base portion, the pair of cantilevered beams formed in opposite sides of the base portion;

wherein the insulative housing forms a pair of protrusions for preventing the cantilevered beams from raising; and wherein said holding device is configured with an upwardly tilting section for allowing the card to be inserted into the card receiving cavity in an oblique angle.

5. The card connector assembly as claimed in claim 4, wherein said holding device applies a downward force against the inserted card at a first position while the contact applies an upward force against the inserted card at a second position which is essentially closer to a front end of the housing in comparison with the first position.

6. The card connector assembly as claimed in claim 4, wherein said holding device is essentially located adjacent to a rear end of the housing.

* * * * *